United States Patent [19]

Hutton

[11] Patent Number: 4,697,482

[45] Date of Patent: Oct. 6, 1987

[54] PLIERS GRIPPING BAND

[76] Inventor: Robert A. Hutton, 10890 Galvin St., Ventura, Calif. 93004

[21] Appl. No.: 875,497

[22] Filed: Jun. 18, 1986

[51] Int. Cl.[4] ..... B25B 13/52

[52] U.S. Cl. ..... 81/64; 81/3.43; 24/20 EE

[58] Field of Search ..... 81/3.43, 64; 24/20 R, 24/20 EE, 23 EE, 273

[56] References Cited

U.S. PATENT DOCUMENTS

| | | | |
|---|---|---|---|
| 635,662 | 10/1899 | Colkitt et al. . | |
| 700,752 | 5/1902 | Erwin . | |
| 1,157,632 | 10/1915 | Maas . | |
| 1,797,446 | 3/1931 | Salmon | 81/64 |
| 2,389,301 | 11/1945 | Escher . | |
| 2,547,748 | 4/1951 | Freer . | |
| 4,470,177 | 9/1984 | Ganung et al. | 24/273 |

FOREIGN PATENT DOCUMENTS

| | | | |
|---|---|---|---|
| 580951 | 7/1933 | Fed. Rep. of Germany | 81/64 |
| 1201663 | 8/1970 | United Kingdom | 81/64 |

*Primary Examiner*—Roscoe V. Parker
*Attorney, Agent, or Firm*—Kenneth J. Hovet

[57] ABSTRACT

A flexible C-shaped band with a pliers engagement opening at each free end. The openings are in alignment with the center axis of the band. An elongated handle extends transversly from the band longitudinal axis.

5 Claims, 7 Drawing Figures

PLIERS GRIPPING BAND

BACKGROUND OF THE INVENTION

1. Field of the Invention

The present invention relates to a tool accessory and, more particularly, to a gripping band adapted for use with pliers.

2. Description of the Prior Art

Jar wrenches and various types of gripping tools have long been used to remove canning jar lids, packing rings and other circular items having a large diameter. In many cases, a flexible band, wire or cable is attached to the end of a pliers. Actuation of the pliers forcefully contracts the band about the item and premits its removal. This usually works adequately when the jar lid or other item is readily accessible and the band can be positioned or looped about the item's periphery.

A problem arises when the item for removal cannot be accessed by the closed band and pliers combination. Exemplary of such are connectors, unions, collars and nuts attached to endless pipes or conduits. With the above, the band must have an opening or it must be disengagable from the pliers so it may encircle the item. Bands, straps and wires that appear to be releasable from the pliers or pincers are shown in U.S. Pat. Nos. 635,662; 700,752; 1,157,632; 2,389,301 and 2,547,748. However, in every case the pliers connection is perpendicular to the center axis of the band. With the band and pliers in the same plane, access to crowded fittings is frequently not possible. Further, none of the prior art contemplated the need for separate manipulation of the gripping band.

SUMMARY OF THE INVENTION

The present invention provides a gripping band that can be positioned about fittings inaccessible to prior art devices. It is separate and independent of pliers, but includes engagement means for releasable connection to pliers in a direction perpendicular to the band plane. A band handle means is also provided to facilitate positioning of the band on difficult to access objects.

DESCRIPTION OF THE PREFERRED EMBODIMENTS

With reference now to the drawings, the gripping band of the invention is shown generally by reference 10. The band is a thin elongated strip 11 of flexible material. It has a predetermined width sufficient to provide adequate strength and gripping area for engaging fittings commonly found in aircraft, vehicles, machinery and buildings. Preferably, the band is constructed of resilient metal such as spring steel, but could be a resilient plastic as dictated by the desired application.

Figure 6:
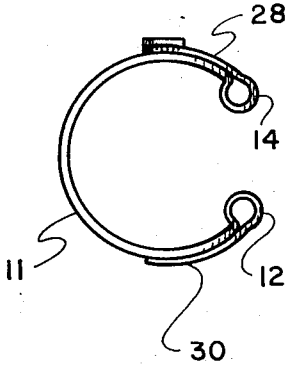
FIG. 6 is a back end elevational view of the band shown in FIG. 1.
Figure 4:
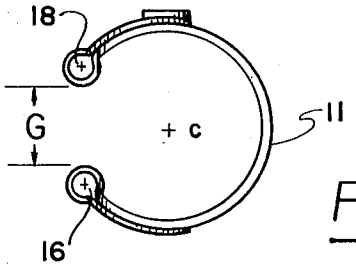
FIG. 4 is a front end elevational view of the band shown in FIG. 1.
Figure 3:
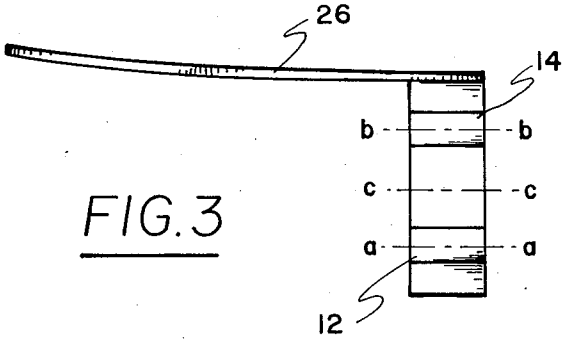
FIG. 3 is a left side elevational view of the gripping band shown in FIG. 1.

The band is formed into a curved shape such as an arc of at least 180° about a center axis c,c. It should have sufficient length (circumference) to partially encircle fittings, as above described, and permit a gap (G) between the opposing free ends 12,14. As best seen in FIGS. 4 and 6, the band has a C-shape with terminal ends 12,14 spaced-apart from each other across gap (G).

Each free end includes an engagement means comprising an opening 16 and 18 at each respective end facing a direction about coextensive with center axis c,c. Preferably, each opening is formed by bending, curling or rolling the free end upon itself about a respective longitudinal axis a,a or b,b to form an annular portion. Each axis is about parallel with the center axis and the openings have sufficient diameter to permit insertion of respective nose parts 22,24 of a pliers 20.

It is expected that the pliers being used with the invention will have jaws that include narrow nose parts that extend about coextensively with respect to the longitudinal axis P,P of the pliers. In this way, the openings 16,18 can be accessed from a direction about a parallel with the gripping band center axis c,c. Pliers suitable for use with the invention are typically referenced as needle nose or snap ring pliers.

A significant advantage of the invention is the ability to locate the band on a fitting prior to being engaged with a larger more cumbersome pliers. To facilitate manipulation of the band in difficult to reach areas, a handle means is attached to the band. As shown, this comprises an elongated member 26 which is attached at one end to the band and extends transversely therefrom. Preferably, it is attached to the band outer circumference adjacent a free end and extends coextensively with the center axis. Attachment may be by spot welding, fusion, adhesion, riveting or the like.

As best shown in FIG. 6, the openings 16,18 have been created by rolling each opposing band end back upon itself and securing the overlap portion 28,30 to the outer circumference of the band. Securement is accomplished by the aforementioned welding, fusion, etc. Such construction permits a smoother band interior for less troublesome gripping engagement with a fitting. Also, using a portion of the band to form the openings, lowers costs and simplifies manufacture.

It will be appreciated that the openings could be created by turning the band ends inwardly or by twisting the free ends 90° with an opening punched therethrough or by engagement means comprising other mechanical structures. Such should have transverse openings arranged coextensive with the center axis to permit longitudinal insertion of pliers nose parts. Examples may be flanged washers, nuts or electrical wire connectors.

Figure 1:
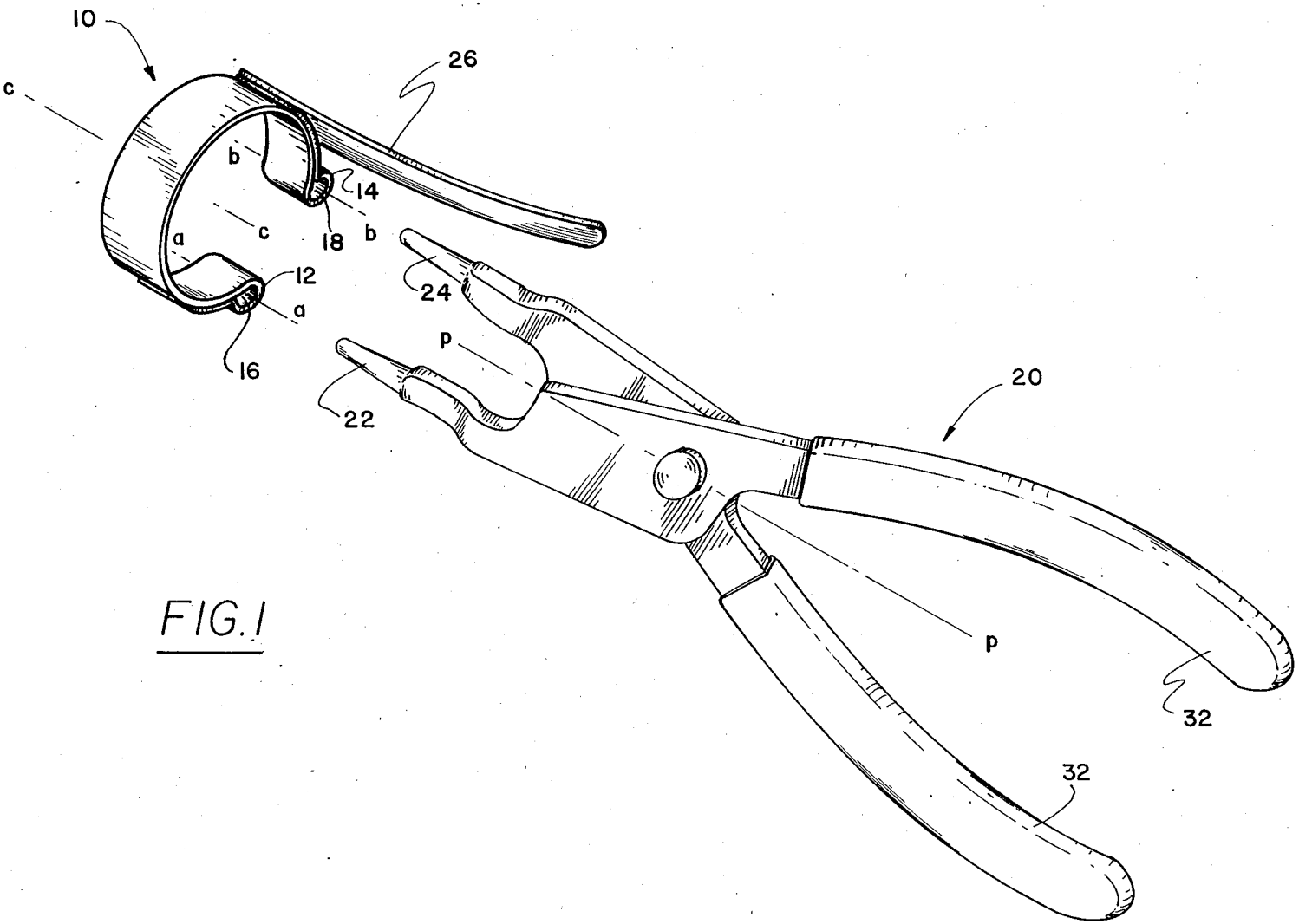
FIG. 1 is a perspective view of the gripping band of the invention exploded from a snap-ring pliers.
Figure 2:
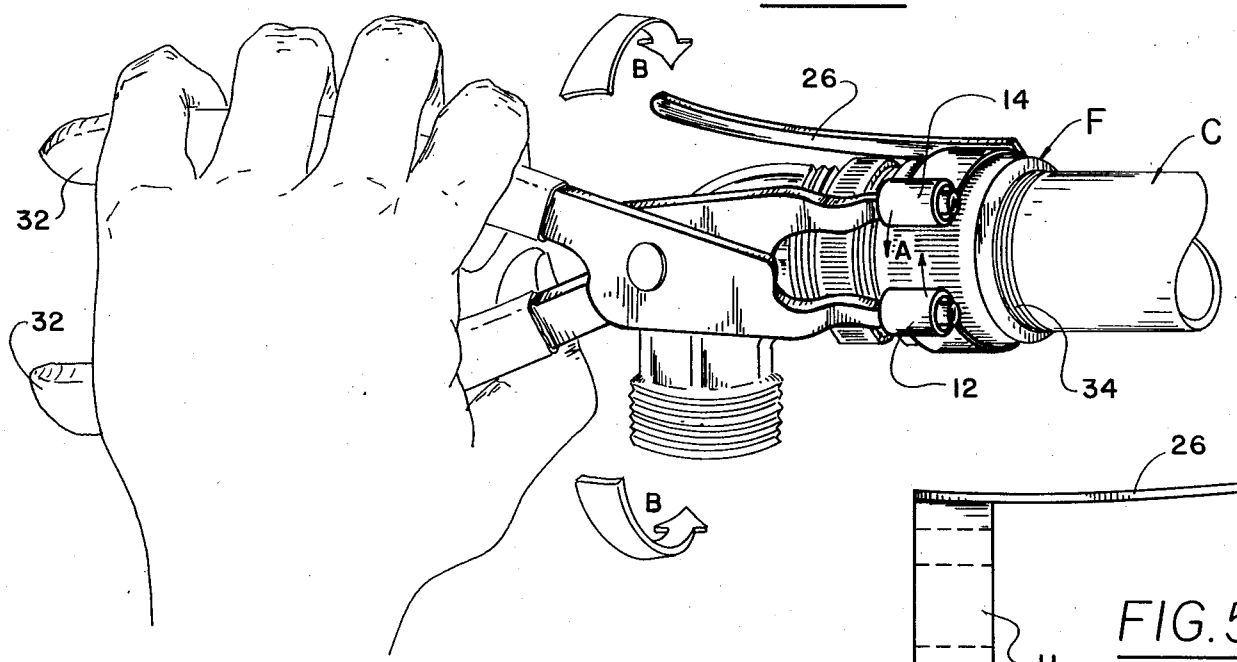
FIG. 2 is a perspective view illustrating the gripping band and pliers of FIG. 1 in use on a conduit connector ring.

In operation, a user will grasp the handle 26 and/or band and position the ends 12,14 on opposing sides of a fitment shown in FIG. 2 as an electrical conduit ring F. The side of the band opposite the gap will be pushed causing the ends to expand and slide over the ring.

With the band overlying the conduit ring, a snap ring pliers 20 is moved along a direction coextensive with the conduit longitudinal axis with nose parts in alignment with axes a,a and b,b. The nose parts are inserted into openings 16,18. Pliers handles 32,32 may then be squeezed to cause the nose parts and free ends to move toward each other as shown by arrows A. This contracts the band diameter and results in a gripping action by frictional engagement of the band inner surface with the outer circumference of the ring.

While maintaining the gripping action, the pliers may be moved orbitally about the conduit as shown by arrows B. This results in a tightening or loosening of the ring about threads 34.

Figure 7:
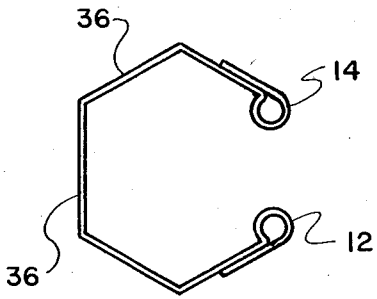
FIG. 7 is a back end elevational view of an alternative outline for the of FIGS. 1–6.
Figure 5:
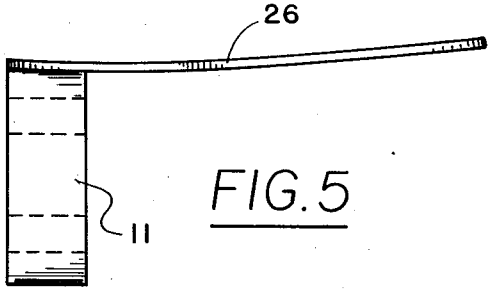
FIG. 5 is a right side elevational view of the band shown in FIG. 1.

FIG. 7 shows an alternative shape to the somewhat circular outline of the band of FIGS. 1–6. In cases where the fitments to be worked upon are polygonal in outline, it may be desirable to optionally shape the band accordingly. As shown, the band has an overall circular planar shape but its longitudinal extent is divided into multiple straight chordal segments 36. The particular number and length of each segment will be dictated by the specific fitting being worked upon. In plumbing applications, pipe unions commonly have a hexagonal outline so the band may be six-sided with segment lengths and overall diameter in correspondence with the faces of the union fitting.

It will be noted that whether or not the band includes straight segments in its outline, the diameter should always permit sufficient gap distance (G) to allow the band to be contracted against the fitting. Because the present invention provides a unique simplified design, manufacturing costs are very low and bands of varying shapes and diameters are readily constructed and affordable.

While the invention has been described with respect to preferred embodiments, it will be apparent to those skilled in the art that various modifications and improvements may be made without departing from the spirit and scope of the invention. Accordingly, the invention is not to be limited by the aforesaid embodiments, but only by the scope of the appended claims.

I claim:

1. A tool accessory for gripping an annular-shaped workpiece extending about an endless pipe or conduit consisting of a C-shaped flexible band having a center axis and opposing free ends which are spaced-apart and void of any structure in the gap between said ends, each end consisting of an opening having a longitudinal axis extending parallel with said center axis and radially equidistant from said center axis, said band having an elongated handle member attached to said band adjacent one of said ends and extending from said band in a direction about coextensive with said center axis.

2. The tool accessory of claim 1 wherein each end of said band is rolled upon itself to form an annular portion.

3. The tool accessory 2 wherein each annular portion is a mirror image of the other annular portion.

4. The tool accessory of claim 1 including a pliers having opposing jaws each with a longitudinally extending nose part inserted within a respective tool annular portion.

5. The tool accessory of claim 1 having straight segments along the longitudinal extent thereof.

* * * * *